United States Patent [19]

Duke

[11] Patent Number: 4,618,174

[45] Date of Patent: Oct. 21, 1986

[54] POWER OPERATED DOOR OPENER LOCK SYSTEM

[76] Inventor: James P. Duke, 3511 Tenaya, South Gate, Calif. 90280

[21] Appl. No.: 563,282

[22] Filed: Dec. 19, 1983

[51] Int. Cl.[4] ..... E05C 19/10

[52] U.S. Cl. ..... 292/135; 49/280; 292/201; 292/237; 292/DIG. 12; 292/DIG. 36

[58] Field of Search ..... 292/130–132, 292/134, 135, 95, 201, DIG. 12, DIG. 36, 237, 127, 119, 230; 49/280

[56] References Cited

U.S. PATENT DOCUMENTS

| | | | |
|---|---|---|---|
| 389,110 | 9/1888 | Roselius | 292/130 |
| 1,118,560 | 11/1914 | Lange | 292/95 X |
| 1,324,428 | 12/1919 | Mair . | |
| 1,662,255 | 3/1928 | Stuart et al. | 292/127 |
| 1,664,576 | 4/1928 | Stuart et al. | 292/119 X |
| 1,701,784 | 2/1929 | Lewis | 292/DIG. 12 |
| 2,526,979 | 10/1950 | Tomlinson . | |
| 2,579,621 | 12/1951 | Smith . | |
| 2,589,479 | 3/1952 | Curtis | 292/DIG. 36 |
| 2,660,765 | 12/1953 | Carlson | 292/DIG. 36 |
| 3,161,426 | 12/1964 | Peras . | |
| 3,259,413 | 7/1966 | Steckle . | |
| 3,266,831 | 8/1966 | Bause . | |
| 3,848,907 | 11/1974 | Shiurila | 292/201 X |
| 4,174,128 | 11/1979 | Styck . | |

*Primary Examiner*—Kenneth J. Dorner
*Assistant Examiner*—Lloyd A. Gall
*Attorney, Agent, or Firm*—Howard A. Kenyon

[57] ABSTRACT

A self locking device that is used with a overhead, horizontally pivoted, door in combination with a power operated door opener is disclosed. The device comprises a latch mechanism that is activated by the movement of the door arm and a striker that receives a locking dog. A door arm, which is a part of the door opener, is the member that transfers the movement of the power operated door opener to the door. When the door arm is closing the door, the locking dog is free to interface with a striker. A striker mounted on the header of the door frame receives the locking dog and keeps the door from being forced open which can be done by breaking the door opener mechanism. The latching dog is released by the door opener mechanism with the reverse movement of the door arm and therefore the door is moved to its open position.

2 Claims, 3 Drawing Figures

POWER OPERATED DOOR OPENER LOCK SYSTEM

BACKGROUND OF THE INVENTION

1. Field of the Invention

This invention relates to a locking device used in combination with a power operated door opener.

2. Description of the Prior Art

The power operated door opener has been used substantially in residential areas in the last few years. The basic drive, either chain or screw, has become more reliable and the motor, gearing, clutches and switches have improved to the point that a failure is rare. In addition, a high rate of production has allowed a lower price whereby many homeowners can afford to install such openers, especially on overhead, horizontally pivoted garage doors. This type of garage door, which is called a "California" door, is used mainly in the Western part of the United States where there is seldom snow and ice to hinder the opening of the garage door.

The "California" door is usually made of wood and it is usually fitted to a two (2) car garage although a one (1) car garage can easily use this type of door. The shear size of this door, even if made from light weight wood such as pine makes the door quite heavy and therefore a balancing spring with the attending mechanism is used to allow a person to lift and close the door. Still, it is inconvenient in inclement weather to get out of the car, open the garage door and get back in the car to drive the car into the garage. In addition, most garage doors require the closing by hand from the outside which is also inconvenient in inclement weather. The power operated garage door opener with a radio control device activated inside the car also provides security whereby a person can open the garage door, drive into the garage and close the garage door behind without unlocking the car doors. All of these factors stated above have created a tremendous market for power operated garage door openers.

However, along with the increased usage of power operated garage door openers, there has been an increase in garage burglaries as two (2) strong men can break the garage door opener mechanism since favorable leverage is provided by the horizontally pivoted garage hinges. The breaking of the mechanism allows the door to be opened and the garage burglarized.

There are no known, self locking, devices for power operated garage door openers, however, there are latch mechanisms on doors, gates and the like which are discussed below.

U.S. Pat. No. 3,259,413 to Steckle describes a door latch with a pivoted cam locking plate. This reference directs itself to a cleanout door on a soaking pit associated with slab mills in the steel industry. The device is activated by a rope which disengages the latching dog allowing the heavy door to fall free and some other means (not shown) is used to close the door which allows the latching dog to catch the lip of the door and hold the door in a closed position. This reference is different in that the latch does not rely on the power of the opening door mechanism to release the latch dog as in the present invention but instead relies on a rope pulled by some outside force.

Another reference is U.S. Pat. No. 1,324,428 to Mair. Mair describes a latch which contains a gravity operated latching dog used primarily for gates. A lever is required to be lifted which lifts the latching dog out of the way of the striker and therefore allows the gate to be opened. Again, the reference clearly does not read on the present invention as the present invention uses the power operated door opener to urge the latching dog to lock the door and to disengage the latching dog to open the door.

Smith in U.S. Pat. No. 2,579,621 describes a latch for an overhead horizontally pivoted door to latch the door in the up position to keep the door from falling to the closed position and injuring someone. Therefore this is a safety latch and locks the door in the open position until some force pulls on a release rope allowing the door to close. This invention is not used in combination with a power operated door opener and further requires pulling on a rope to release the latch which is not required by the present invention.

Piras in U.S. Pat. No. 3,161,426 describes a latch for use on automobiles such as the one used for the automobile hood. The latch is released by pulling on a cable located in the dashboard of the automobile. This invention does not teach a device that is self latching and self releasing and used in combination with a power operated door opener.

Other references of interest are U.S. Pat. No. 2,526,979 to Tomlinson, U.S. Pat. No. 4,174,128 to Styck and U.S. Pat. No. 3,453,014 to Johnson.

The novel features which are believed to be characteristics of the invention, both as to its organization and its method of operation, together with further objects and advantages thereof, will be better understood from the following description in connection with the accompanying drawings in which a presently preferred embodiment of the invention is illustrated by way of example. It is expressly understood, however, that the drawings are for purposes of illustration and description only, and are not intended as a definition of the limits of the invention.

SUMMARY OF THE INVENTION

It is the object of this invention to provide a self locking latch to secure an overhead horizontally pivoted door.

It is another object of this invention to use a self locking latch in combination with a power operated door opener.

It is yet another object of this invention to provide an all mechanical, highly reliable self locking latch.

It is still another object of this invention to provide a low cost, easily installed self locking latch that can be installed on existing power operated, overhead, horizontally pivoted doors with a simple modification to the door arm.

Briefly, in accordance with the invention, there is provided a self locking latch that is all mechanical and simple in construction and operates in combination with a power operated door opener. The latch is designed to be used with an overhead horizontally mounted one piece door. A pin connected to the power operated door opener door arm slides forward in a horizontal slot allowing a latching dog on a hooking member to engage a recess in a striker member thereby locking the door. In order to release the latching dog, the power operated door arm moves a pin rearward that strikes a projection on the hook member thereby releasing the latching dog and allowing the garage door to open.

While the invention will be described in connection with the preferred embodiments, it will be understood that it is not intended to limit the invention to those embodiments. On the contrary, it is intended to cover all alternatives, modifications, and equivalents that may be included within the spirit and scope of the invention as described in the appended claims.

DETAILED DESCRIPTION OF THE PREFERRED EMBODIMENT

Figure 1:
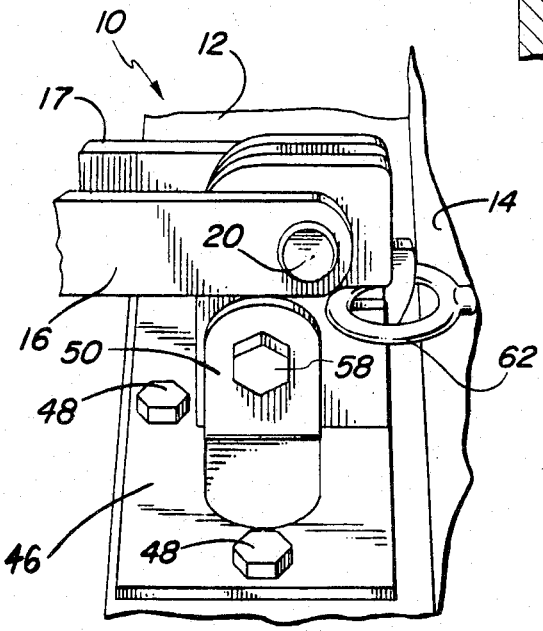
FIG. 1 is a perspective view of the power operated door lock system.

As shown in FIG. 1, the power operated door opener system, generally shown as 10, according to the teaching of this invention is all mechanical and fitted between the door header 12 and the door frame header 14. The door header 12 is a wooden member spanning across the top of the door to provide structural rigidity. The door frame header 14 is a wooden member spanning across the top of the door frame to distribute the load of the upper part of a building to the vertical members of the door frame. (FIGS. 6 and 7 have been added to clarify the description of headers.) The latch mechanism involves but two moving parts which makes the mechanism very reliable.

A power operated door opener (or closer) is basically a motor with limit switches to control the movement of the motor. The power operated door opener limit switches are set such that the door closes firmly with the door header 12 pressing firmly against the door frame header 14. At the point of closure, the motor is cut off and a power operated clutch mechanism prevents the motor from continuing to turn thereby holding the door in the closed position. In the present invention, this combination is expressed as power means 45 in FIG. 5.

FIG. 1 shows the lock system in its fully locked position. When the door 13 is open and the power operated door opener is activated to close the door, the door arms 16 and 17 are moved in a direction toward the door frame header 14 by the drive means 43 of the power operated door opener. The drive means 43 may be either a screw drive or a chain drive, however, both serve the same function of moving door arms 16 and 17 to close and open the door.

Figure 2:
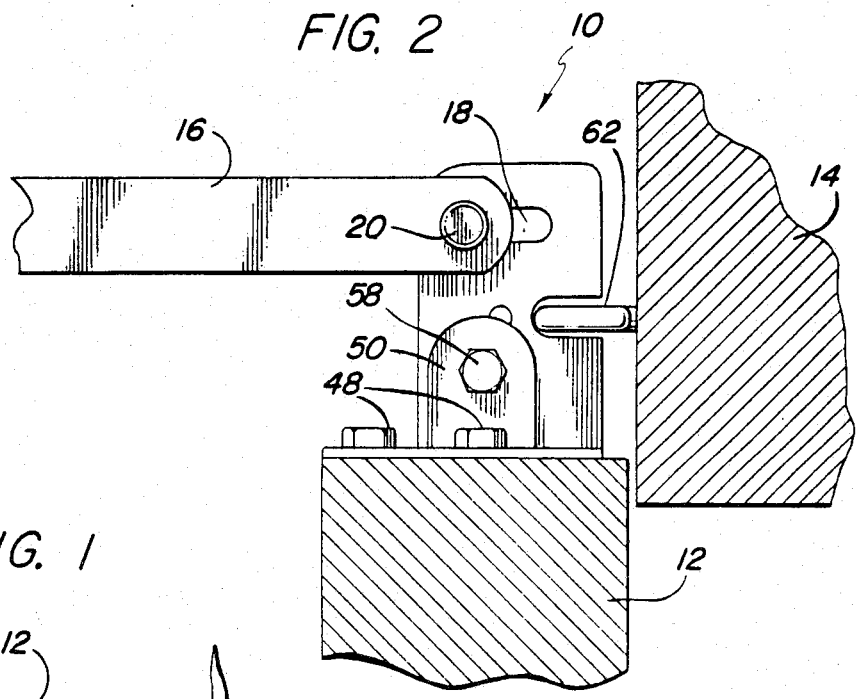
FIG. 2 is a side view of the power operated door lock system.

FIG. 2 shows a side view of the lock system showing the horizontal slot 18 and the releasing means or pin 20. FIG. 2 also shows the lock system after the power operated door opener has been activated to open and the pin has moved in the horizontal slot to its aft position. This places the lock system in the unlocked position.

Figure 3:
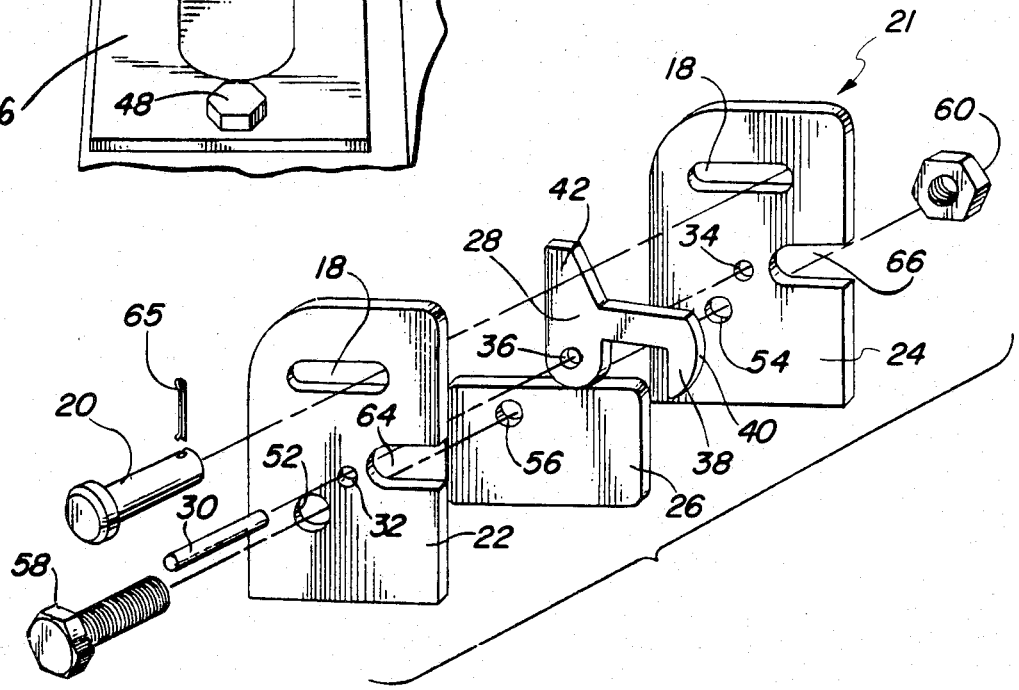
FIG. 3 is an exploded view of the self locking latch mechanism.

FIG. 3 is an exploded view of the latch mechanism generally indicated as 21. The latch side plates 22 and 24 have a fixed spacer 26 fitted therebetween. A hook member 28, which is slightly thinner than the spacer 26 is also fitted between the latch plates 22 and 24. Hook member 28 is pivotally mounted by pin 30 which fits in holes 32 and 34 of latch plates 22 and 24 respectively. Since the hook member 28 is slightly thinner than spacer 26, and hole 36 in hook member 28 is slightly larger than pin 30, hook member is free to rotate inside latch plates 22 and 24. Pin 30 is slightly larger than the holes 32 and 34 such that when pin 30 is inserted into holes 32 and 34, pin 30 is held in place by press fit. Hook member 28 has a latch dog 38 which has an arcuate end 40 and a top projection 42. A pin 20 fits into the horizontal slot, shown in FIG. 2 as 18, which is the releasing means of the latch system.

Figure 4:
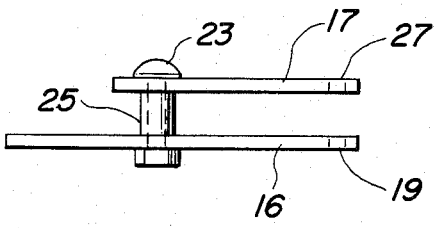
FIG. 4 is a top view of the door arm for opening and closing the door.

FIG. 4 is a top view of arms 16 and 17 which shows arm 17 is fastened to arm 16 by a fastening means. Holes 19 and 27 in FIG. 4 receive pins 20 as shown in FIGS. 1 and 2.

Figure 5:
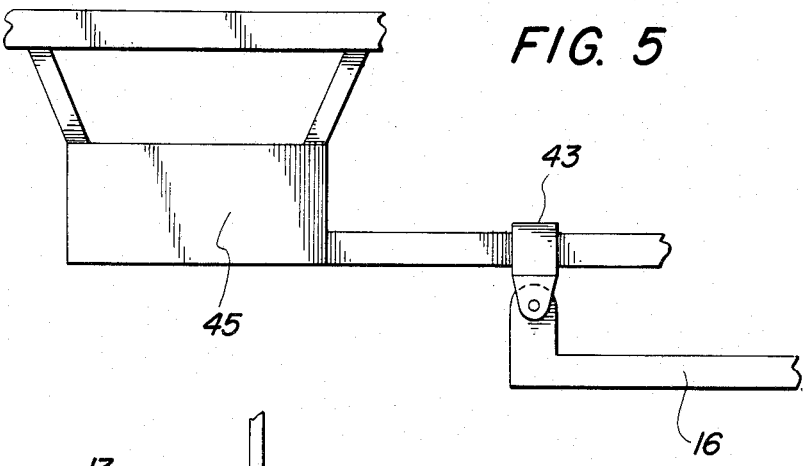
FIG. 5 is an outline view of a power means and a drive means.

FIG. 5 is a side view of drive means 43 and power means 45. Power means 45 must be connected to some kind of structure for proper operation. The drive means 45 may be connected to either a chain or a screw, however, both the chain and the screw serve the same function, which is to open and close the door and either can be utilized by the present invention.

Figure 6:
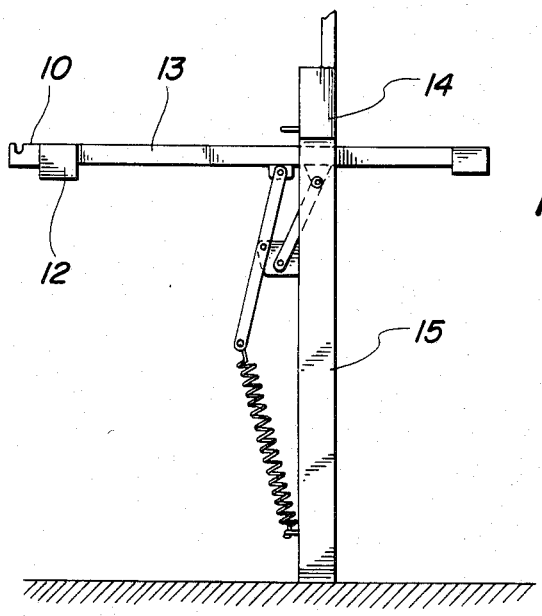
FIG. 6 is a side view of an overhead horizontally pivoted door mounted in a door frame in an open position.

FIG. 6 shows an overhead, horizontal pivoted door 13 mounted in a door frame 15.

Figure 7:
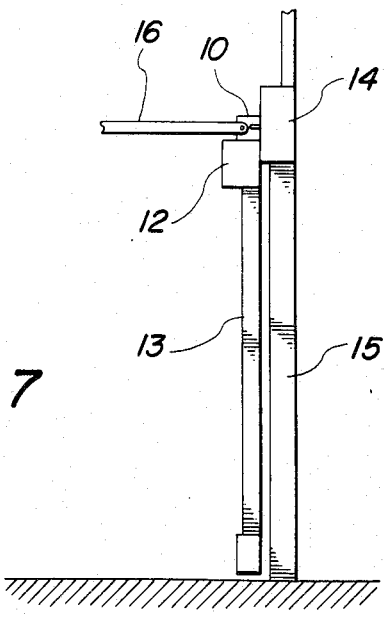
FIG. 7 is a side view of an overhead horizontally pivoted door, without the pivot mechanism, in a closed position.

FIG. 7 shows the door 13 in a closed position. FIGS. 6 and 7 define the position of the door to show the relationship of the door 13, door frame 15, door header 12, and door frame header 14 to the lock system.

As seen in FIGS. 1 and 2, a bracket preferably made of heavy sheet metal is fastened to door header 12 preferably by bolts 48. Lag screws can be used if the door header 12 is sufficiently thick to provide a firm attachment of bracket 46.

FIGS. 1 and 2 also show the bracket 46 to have ears 50, one on each side, which has a hole in alignment with hole 52 and 54 of latch plates 22 and 24 respectively. The holes 52 and 54 are also in alignment with hole 56 in spacer 26. Bolt 58, which is slightly smaller than the holes in the bracket ears and holes 52, 54 and 56, is placed through the above holes as the latch mechanism 21 is assembled. The assembly is accomplished by placing the spacer 26 between the latch plates 22 and 24 and inserting bolt 58 through the holes in ears 50 and through holes 52, 54 and 56. Nut 60 is then placed on bolt 58 and tightened firmly. Hooking member 28 is then placed between latch plates 22 and 24 such that holes 32, 34 and 36 are in alignment. Pin 30 is pressed in place in holes 32 and 34 passing through hole 36.

Once the bracket 46 is attached to door header 12, a striker 62 can be aligned with grooves shown as 64 and 66 in FIG. 3. The striker 62 in the preferred embodiment is an eye bolt which has threads on one end that are screwed into door frame header 14. The striker may be designed to be any member that will fit into grooves 64 and 66 and receive latching dog 38. However, the preferred embodiment striker 62 is inexpensive, available at any hardware store and can be used as an adjustment by screwing 180° to move the striker either closer or further away from door frame header 14. It can be seen that as the power operated door opener latch system moves to the closed position, the arcuate end 40 of hook member 28 will hit the striker 62 in grooves 64 and 66. In the preferred embodiment, the hook member will be forced up and the latching dog 38 will fall into the striker 62 by gravity force. This type of force is very reliable and simple, however, a compression spring (not shown) could be designed to fit on top of hook member 28 to force latch dog 38 into striker 62. However, this would be an additional member that would increase the cost of the latch mechanism and be a source of wear out and failure. Since in the preferred embodiment the latching dog falls into the striker by gravity force, this action clearly describes the latch in the present invention as a self locking latch.

Referring to FIGS. 1 and 4 there is seen two (2) door arms 16 and 17 having holes 19 and 27 in the ends in which pin 20 is to be fitted. Most existing door openers have only one (1) door arm 16. To utilize the present invention, an additional arm 17 must be installed which can be done with a spacer 25 and bolt 23 to keep the door arms parallel and at the width required to fit on the ends of pin 20. After the additonal arm 17 is installed, pin 20 is inserted through the hole 19 in the end of door arm 16, through slot 18 in side plates 22, through the hole 27 in the end of door arm 17. The pin 20 then secured by a cotter key 65 through a hole in the end of pin 20.

In defining the closing and locking operation, when the power means 45 in FIG. 5 is energized and the drive means 43 moves the door arms 16 and 17 toward door frame header 14, pin 20 is also moved toward door frame header 14 in slot 18. As the door header and latch system continues to move toward the closed position, the arcuate end 40 of latch dog 38 engages striker 62 allowing the hook member 28 to pivot around pin 30 thereby raising latch dog 38 sufficiently to be urged up and over the end of striker 62. The latch dog 38 then falls by gravity force inside of striker 62. The door is now in a locked position and any attempt to open the door will be resisted by the latch dog 38 inside of striker 62.

To open the door, the power means 45 is energized and the drive means 43 is reversed which moves the door arms 16 and 17 away from the door frame header 14. As can be seen, the pin 20 will move away from the door frame header 14 in slot 18. Pin 20 therefore engages the bearing surface of projection 42 on hook member 28 which rotates hook member 28 about pin 30 and lifts the latching dog 38 such that it will clear striker 62 as the door arms 16 and 17 continue to move the therefore the door 13 continues to move toward the open position.

It will be readily apparent to those skilled in the art that various modifications and changes can be made without departing from the spirit of the invention.

While an operating example of this invention has been described with some particularity, it will be understood that modifications may be made therein, within the scope of the following claims.

I claim:

1. A system for locking a power operated door comprising:

(a) an overhead, horizontally pivoted door mounted in a door frame;

(b) a power operated door opener arm for opening and closing said door;

(c) driving means connected to said door arm;

(d) power means connected to said driving means;

(e) latching means for locking said door in a closed position wherein said latching means is a self-locking latch, containing a latching dog, mounted between the header of said door and the header of said door frame and activated by said power operated door arm;

(f) a striker mounted on said door frame header adapted to engage and receive said latching dog and hold said door in a locked position;

(g) a mounting bracket to mount said latch to said door header;

(h) releasing means to disengage said latching dog;

(i) first and second latch side plates with a fixed spacer fitted therebetween, and (j) a hook member whose thickness is less than said spacer and pivotally attached to said side plates wherein said hook member will freely move and rotate about said pivot and engage said striker by gravity force.

2. A method of locking a power operated door comprising:

(a) providing a horizontally pivoted overhead door mounted in a door frame;

(b) providing a power means;

(c) providing a driving means attached to said power means wherein said power means is capable of forward and reverse movement of said driving means whereby said forward and reverse movement closes and opens said door;

(d) moving said door by an arm connected to said driving means on one end and connected to a latching means on the other end, said latching means being a self-locking latch comprised of two sideplates with a horizontal slot therein, a spacer affixed between said side plates, a hook member pivotally mounted between said side plates with a projection on one end and a latching dog on the other end, said hook member's thickness being less than that of said spacer to allow said hook member to freely move between said side plates, a pin extending through said horizontal slot of said side plates, said pin also being connected to the end of said arm, whereby said self-locking latch is contained in a bracket mounted on the header of said door;

(e) activating said self-locking latch as said door obtains a closed position by urging said self-locking latch to a locked position by said arm wherein said latching dog engages a striker mounted on the header of said door frame, said striker adapted to receive said latching dog whereby said latching dog is placed in said striker by gravity force and secures said door in a locked position;

(f) activating said self-locking latch to open said door by urging said self-locking latch to an open position by said arm wherein said projection of said hook member is engaged by said pin sliding in said horizontal slots of said first and second side plates when said door arm moves toward its open position thereby rotating said hook member about its pivot point and subsequently releasing said latching dog from said striker allowing said door to move toward its open position.

* * * * *